US005283836A

United States Patent [19]

Trufitt

[11] Patent Number: 5,283,836

[45] Date of Patent: Feb. 1, 1994

[54] PLANAR SPEAKERS

[76] Inventor: Anthony L. Trufitt, 13 Dellas Avenue, Templestowe, Victoria 3106, Australia

[21] Appl. No.: 842,350

[22] PCT Filed: Sep. 21, 1990

[86] PCT No.: PCT/AU90/00442

§ 371 Date: Mar. 23, 1992

§ 102(e) Date: Mar. 23, 1992

[87] PCT Pub. No.: WO91/04643

PCT Pub. Date: Apr. 4, 1991

[30] Foreign Application Priority Data

Sep. 22, 1989 [AU] Australia ..... PJ6521

[51] Int. Cl.[5] ..... H04R 25/00

[52] U.S. Cl. ..... 381/199; 381/203; 381/193

[58] Field of Search ..... 381/190, 191, 192, 193, 381/194, 205, 202, 203; 181/167, 169, 170, 177, 195, 152, 153, 191, 179, 188

[56] References Cited

U.S. PATENT DOCUMENTS 3,919,499 11/1975 Winey ..... 381/196

4,384,173 5/1983 Briefer et al. ..... 381/158

*Primary Examiner*—Jin F. Ng

*Assistant Examiner*—Sinh Tran

*Attorney, Agent, or Firm*—Foley & Lardner

[57] ABSTRACT

A loud speaker element including a frame which supports a planar diaphragm, an electric conductor in the form of a coil or grid being secured to the diaphragm, and magnetic field generating means being provided to generate magnetic fields which intersect the conductor. The element is characterized in that the diaphragm is made of lightweight, woven cloth having open mesh. The conductor is secured to a first region of the diaphragm. The open mesh at the first region is closed by means such as lacquer or stencil film. The second region of the diaphragm surrounds the first region. The frame covers the second region and acts as a baffle to prevent signal cancellation at lower frequencies.

14 Claims, 3 Drawing Sheets

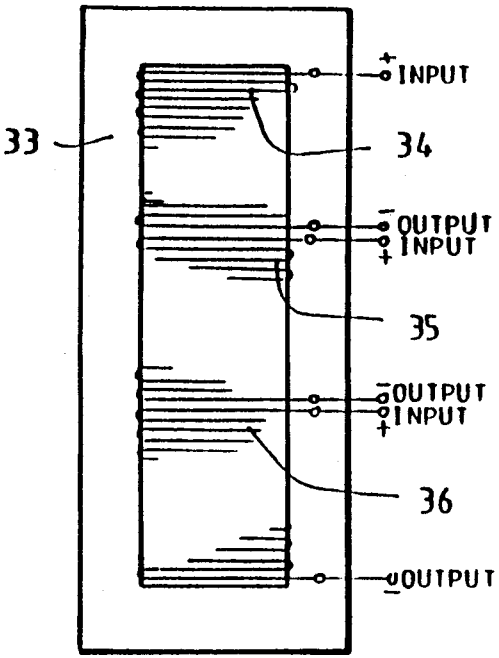
FIG. 7.
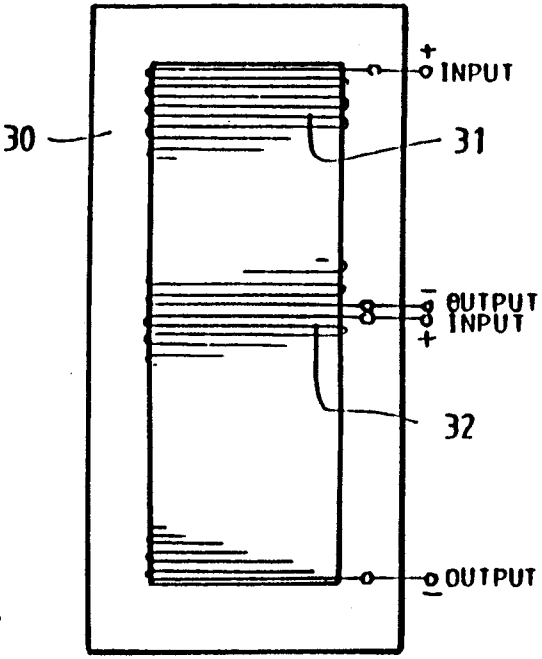
FIG. 5.
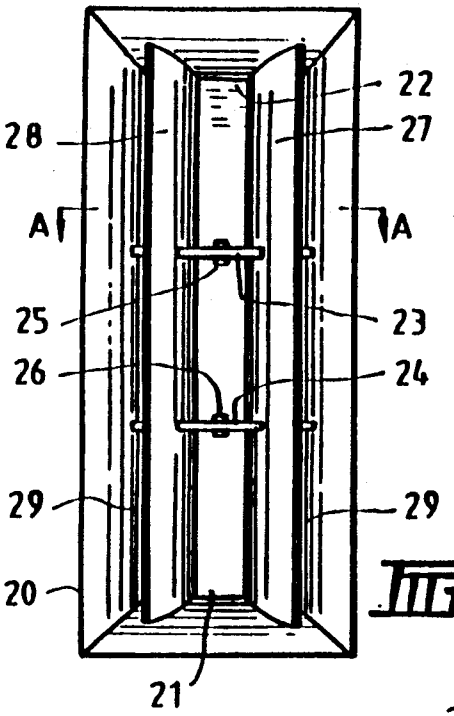
FIG. 6.
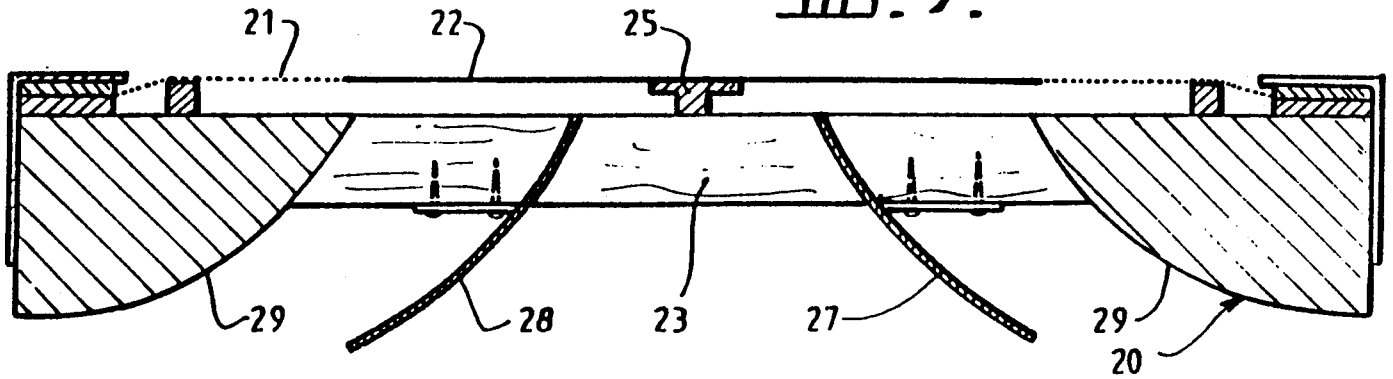

PLANAR SPEAKERS

FIELD OF THE INVENTION

This invention relates to audio transducers and particularly to planar diaphragm loudspeakers.

BACKGROUND OF THE INVENTION

Planar diaphragm loudspeakers have been in use for over twenty years but have never achieved the same popularity as cone-type speakers, due primarily to their cost and to their size and different performance characteristics.

Numerous examples of such speakers may be found in the patent literature, for example, U.S. Pat. No. 3,674,946 Winey, U.S. Pat. No. 3,919,499 Winey, U.S. Pat. No. 3,829,623 Willis et al, U.S. Pat. No. 4,468,530 Torgeson and U.S. Pat. No. 4,471,172 Winey. The last mentioned patent illustrates the structure of a typical planar diaphragm speaker, which comprises a polyester film diaphragm, a current carrying conductor adhered to the diaphragm, spaced bar magnets for generating a magnetic field which intersects the conductor, with the conductor typically being positioned in alignment with the gaps between the bar magnets. When an exciting current passes through the conductor, the diaphragm will be vibrated by the reactive forces generated by the interfering magnetic fields surrounding the conductor and between the adjacent bar magnets.

Most existing planar diaphragm speakers in commercial production utilize polyester film, such as Mylar (registered trade mark) having a thickness of the order of 0.01 mm to 0.1 mm. The present applicant believes that the quality of sound produced by speakers constructed in this way is to a certain extent colored by the use of polyester film or similar materials. Furthermore, the use of such materials results in manufacturing difficulties, such as the ease with which the film may be properly tensioned and the care with which the film must be handled during manufacture.

SUMMARY OF INVENTION AND OBJECT

It is an object of the present invention to provide an improved planar diaphragm loudspeaker in which the above described disadvantages are at least ameliorated.

The invention therefore provides an audio transducer comprising a planar diaphragm, a conductor defining a voice coil or grid secured to said diaphragm, and means for creating magnetic fields which intersect said conductor, said diaphragm being supported in a tensioned overlying relationship with said magnetic field creating means, characterized in that said planar diaphragm comprises a lightweight woven cloth having a first region substantially coincident with said voice coil or grid treated to close the open mesh of the woven cloth, and a second region substantially surrounding said first region in which the mesh of said cloth is substantially open and baffle means overlying but spaced from said second region.

The use of a suitable treated woven cloth having a perimetral open mesh region results in a significant reduction in out of phase vibrations and distortion of the regions which are not under the direct influence of the voice coil or grid and the magnetic fields. Furthermore, the woven cloth is stronger and more flexible than polyester film and may be more easily and more effectively tensioned and handled during the manufacturing process than polyester film. Best results are achieved when the diaphragm is very taut and such tautness is more easily achieved when a suitable woven cloth is used.

One suitable woven cloth material comprises a polyester mesh of the type used in the screen printing industry. Silk screening mesh is particularly suitable because it is made up of monofilaments which are woven to extremely accurate tolerance so the woven cloth has a predictable weight thickness and strength characteristics. It is preferred that high quality cloth, such as ZBF, be used for best results.

If desired, a finer mesh may be selected for speaker elements required to produce higher frequency sound, and in this regard a screen mesh having about 100–120 threads per centimeter has been found to be suitable. Similarly, a coarser mesh, say having only 90 to 100 threads per centimeter may be used for speaker elements required to produce lower frequency sounds. However, the weight of the cloth selected is not particularly critical bearing in mind that the weight of the conductor secured to the diaphragm is substantially greater than the weight of the cloth. Nevertheless, a relatively lightweight high quality material, of the type described above, should preferably be used. Cloth having up to 185 threads/cm are available and may be used.

The open mesh of the diaphragm may be treated in a number of ways to close the mesh in the first region of the diaphragm, to which the parallel runs of conductor wire are secured, for example by lightly spraying the mesh in this region by means of a suitable lacquer, or by photographically applying a film stencil to the mesh in this region. The parallel runs of conductor are preferably adhesively secured to the treated mesh by means of an adhesive which is compatible with the lacquer or the film stencil.

The magnetic field creating means most conveniently comprises a multiplicity of bar magnets mounted in spaced parallel relation to each other such that the spaces between adjacent magnets is substantially coincident with the similarly parallel elements of conductor defining the voice coil or grid.

The bar magnets are preferably mounted on a rigid frame to define a magnetic assembly. The frame may preferably comprise parallel steel tubes or bars secured to a supporting frame which surrounds the perimeter and supports the diaphragm.

The diaphragm is preferably isolated from the supporting frame and from the magnetic assembly, and the frame is preferably made from a suitable high density, high strength wood such as machined craft wood, M.D.F., by being supported between strips of less dense material such as balsa-wood or some other suitable vibration absorbing material such as suitable rubber strips.

The diaphragm preferably has adjustable tensioning means, which in one form of the invention conveniently comprises square or rectangular dowels of balsa-wood or similar vibration absorbent material positioned between the supporting frame and the diaphragm along each side of the diaphragm for at least most of its length. Thus, by forcing the dowel outwardly with respect to the diaphragm, the tension applied to the diaphragm by the dowel may be easily increased without altering diaphragm magnet spacing.

In a preferred form of the invention, the audio transducer has two generally planar louvres mounted in overlying relationship with said diaphragm and supported at an angle to the plane of said diaphragm of about 45°, said louvres being in spaced generally parallel relationship to leave a central strip of said diaphragm exposed and being inclined towards opposite sides of said diaphragm.

The positioning of the louvres in the above manner increases the dispersion of the sound generated by the audio transducer and creates a narrow central portion of the speaker which acts in the nature of a line source, which in turn improves the performance of the speaker in addition to increasing the dispersion of the sound produced thereby.

The louvres may be made from any suitable material and may be supported in any suitable manner, such as by direct attachment to the surrounding frame means. Alternatively, the louvres may be attached to a central cross bar or two spaced cross bars, which preferably have a foot member which bears on the diaphragm to improve the sound reproduction at high power inputs, this being a known means of preventing the sound "breaking up" at high power inputs.

A loudspeaker embodying the invention may comprise two, two or three or more audio transducer elements constructed in the manner defined above and connected in series, without intervening cross-over networks, with each speaker element being adapted to reproduce a slightly different frequency range. For example, a first speaker element may be constructed as defined above using a copper conductor having a diameter of approximately 0.4 mm to reproduce mid-range frequencies, a second speaker element may be constructed using copper wire having a diameter of about 0.2 to 0.25 mm to reproduce high frequency sounds, while a third speaker element may be constructed using 0.4 to 0.5 mm diameter copper wire to reproduce low frequency sounds. If desired, the low frequency speaker elements may include a coarser mesh cloth, for example 90–100 threads/cm, as defined above. The speaker elements may be arranged in any desired manner, but may be preferably arranged in a vertical array with the first speaker element at the top, the second speaker element in the middle and the third speaker element at the bottom.

A two panel array comprising the first and second speaker elements defined above may also be used.

Alternatively, a single diaphragm may carry three regions of different gauge wire, joined in series. For example a first third of the diaphragm may carry wire of about 0.4 mm diameter, a second third of the diaphragm may carry wire of about 0.2 to 0.25 mm diameter, while the last third may carry wire about 0.4 to 0.5 mm diameter. The cloth may have a mesh density of about 100–120/cm.

In another aspect, the invention provides a planar loudspeaker comprising a plurality of planar speaker elements of relatively small dimensions constructed to respond to differing frequency bands, said speaker elements being connected in series and parallel without intervening cross-over networks.

In a still further aspect, the invention provides an audio transducer comprising a planar diaphragm, a conductor defining a voice coil or grid secured to said diaphragm, and means for creating magnetic fields which intersect said conductor, said diaphragm being supported by a surrounding frame member such that a generally rectangular portion of said diaphragm is exposed, characterised by at least two generally planar louvres mounted in overlying relationship with said diaphragm and supported at an angle to the plane of said diaphragm of about 45°, said louvres being in spaced generally parallel relationship to leave a central strip of said diaphragm exposed and being inclined towards opposite sides of said diaphragm.

BRIEF DESCRIPTION OF THE DRAWINGS

One presently preferred form of the invention will now be described with reference to the accompanying drawings in which:

FIG. 5 is a front view of a planar speaker panel embodying the invention;

FIG. 6 is an enlarged sectional end elevation taken along the line A—A in FIG. 1, and FIG. 7 is a schematic front view of two speaker panels showing another modification.

DESCRIPTION OF PREFERRED EMBODIMENT

Figure 1:
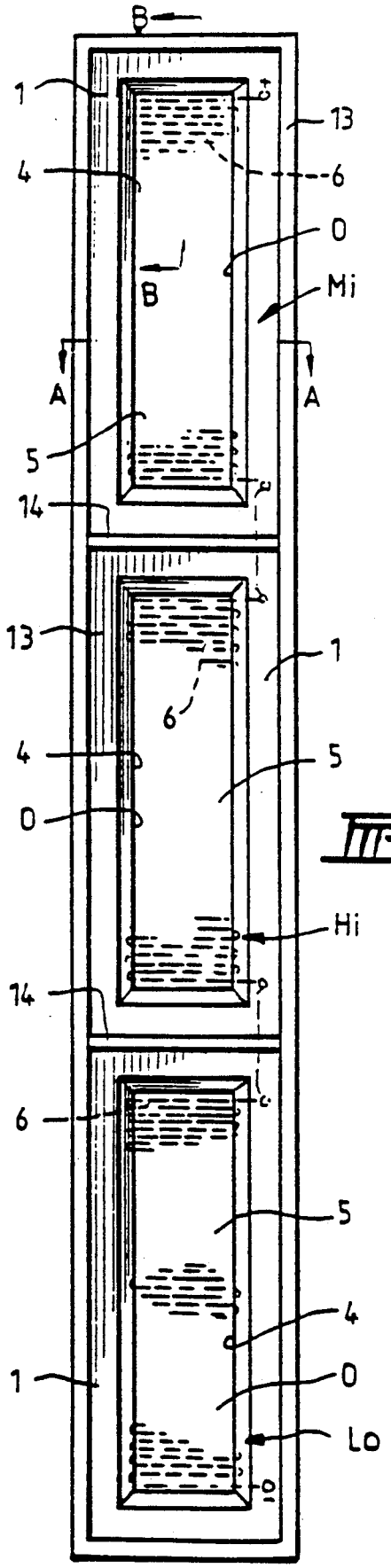
FIG. 1 is a front elevation of a speaker array embodying the invention.
Figure 2:
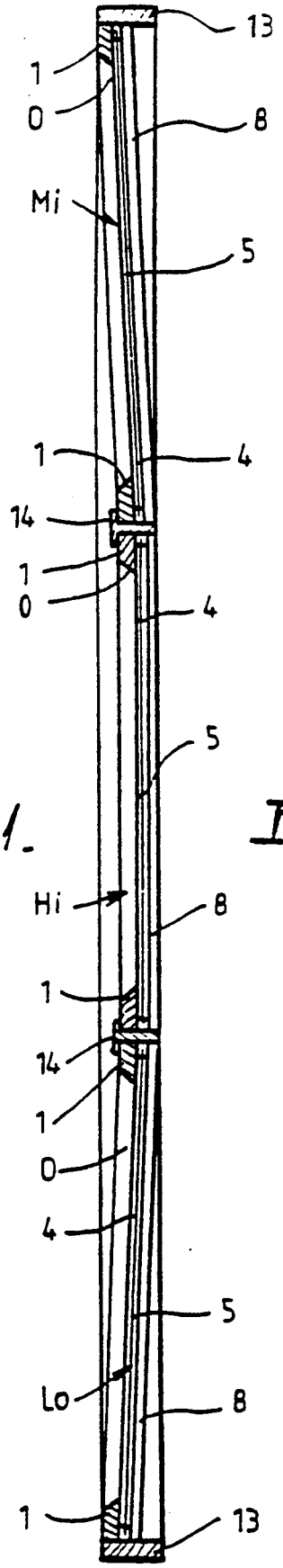
FIG. 2 is a sectional elevation of the speaker array of FIG. 1.

Referring firstly to FIGS. 1 and 2 of the drawings, a speaker embodying the invention will be seen to comprise three speaker elements Mi, Hi and Lo, each having a surrounding supporting frame 1, said speaker elements being supported within a surrounding frame 13 and separated by cross bars 14 extending between the sides of the frame 13. It will be noted from FIG. 2 that the speaker elements are arranged in an inwardly dished fashion to provide a degree of focusing of the sound produced by the respective speaker elements. As shown in FIG. 1, the speaker elements are connected in series, without intervening cross-over networks.

Figure 3:
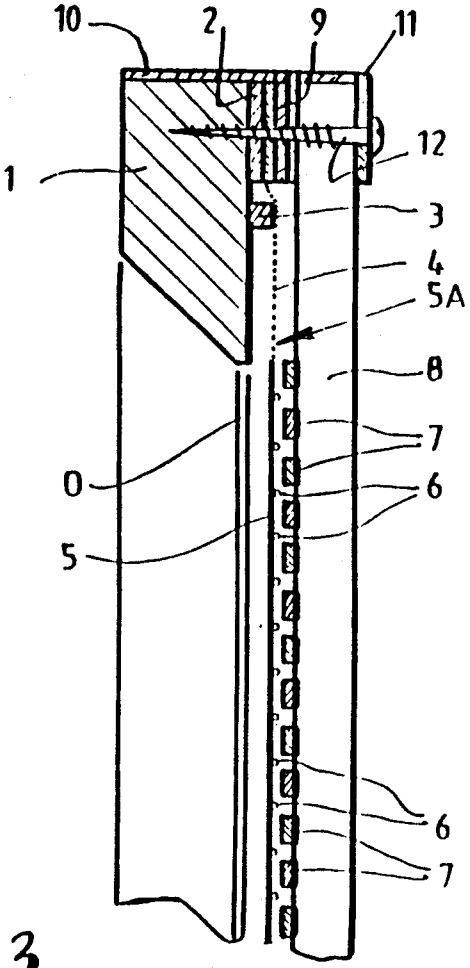
FIGS. 3 and 4 are sectional elevations taken along the threads B—B and A—A respectively in FIG. 1.
Figure 4:
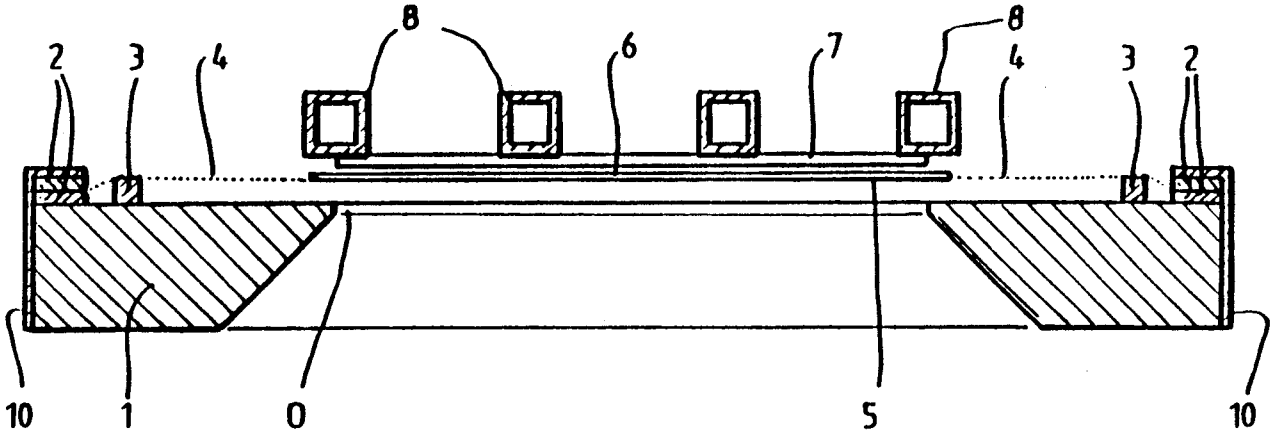

Referring now to FIGS. 3 and 4 of the drawings, the construction of one speaker element will now be further described, it being understood that each speaker element has essentially the same construction, with modifications to be discussed further below.

Each speaker element includes a frame 1 defining a central opening O and supporting a diaphragm 4 of woven cloth, such as polyester open mesh material of the type used in the screen printing industry. Good results are achieved by the use of Swiss cloth sold under the product designation ZBF. The openness of the mesh defining the diaphragm 4 is preferably selected in accordance with the frequency range to be reproduced by the speaker element, although this is not by any means critical. For example, the mid-range and high frequency speaker elements Mi and Hi may have a diaphragm cloth 4 having about 120 threads per centimeter, while the low frequency speaker element Lo may have diaphragm cloth 4 having 100 threads per centimeter.

A central rectangular region 5 of the diaphragm cloth 4 has its open weave or mesh closed by means of a light spraying of lacquer or by means of a photographically applied film stencil of the required dimensions. The portion 5 of the diaphragm 4 having its open weave closed corresponds to the dimensions of the opening O, and in the case of the specific embodiment shown the diaphragm dimensions are about 530 mm×190 mm while the "driven" dimensions are about 457 mm×115 mm. Thus, an open weave or mesh portion 5A surrounds the closed portion 5 for the reason to be discussed further below, and the frame 1 covers the portion 5A and acts as a spaced baffle for that portion to prevent signal cancellation at lower frequencies. The diaphragm 4 is spaced from the frame 1 to prevent contact between the diaphragm 4 and the frame 1 when the diaphragm is driven.

The closed portion 5 of the diaphragm 4 has a multiplicity of parallel runs of copper wire 6 adhesively secured to the coating which closes the open mesh 4. Where the coating is acrylic lacquer, a compatible adhesive, such as a suitable acetone based adhesive, is used to securely adhere the wire 6 to the coated portion 5.

A multiplicity of parallel arrays of bar magnets 7 are secured by vertical tubular frame members 8 of steel which rigidly support the bar magnets 7 and severely restrict their movement with respect to the wire 6 and the coated portion 5 of the diaphragm 4. The frame members 8 are rigidly secured to a cross member 11 and are secured to the frame 1 by means of screws 12. It will be noted that the bar magnets 7 are positioned and spaced such that the parallel runs of wire 6 are positioned intermediate the bar magnets and are therefore positioned in the magnetic flux extending between adjacent magnets.

In the present embodiment, three bar magnets 7 extend across the width of the closed portion 5 and may comprise any suitable ceramic or other magnetic material providing the required magnetic field to react with the electromagnetic field generated by the variable current applied to the wire 6. While each magnet row in the present case comprises three separate magnets, this was dictated by the magnets available to the inventor rather than by any special advantage flowing from the use of multiple magnets. The magnets in question are approximately 5 mm wide×38 mm long×2 mm thick and are intended for use in reed switches. The magnets 7 are adhesively secured to the frame members 8. It will be appreciated that they may be replaced by magnetized strips of materials such as rubber bonded barium ferrite or of samarium cobalt in a polymer binder or sintered samarium cobalt or longer lengths of ceramic magnetic material.

The open surrounding portion 5A of the diaphragm 4 is clamped between surrounding strips 2 of balsa-wood or some other form of vibration absorbing material and the diaphragm 4 is tensioned by square dowels 3 of balsa-wood or other vibration absorbing material positioned between the frame 1 and the diaphragm 4 and extending for the length of each side of the frame 1. The clamping pads 2 are held in position by angle sections 10 of aluminium or other suitable material held in place by means of screws (not shown). Tensioning of the diaphragm 4 is achieved by moving the dowels 3 outwardly with respect to the opening O in the frame 1. Such adjustment may be achieved at any time by inserting a thin probe between the frame 1 and the diaphragm 4 to push each dowel 3 outwardly with respect to the frame 1.

The required spacing between the magnets 7 and the wire 6 is achieved by spacers 9 inserted between the frame members 8 and the angle section 10. The required spacing may be adjusted by means of shims or other suitable spacers. In the present embodiment, a spacing of the order of 1 to 2 mm is satisfactory while the spacing between adjacent magnets 7 is about 5 mm. The spacing between the magnets and the diaphragm may be less than 1 mm without contact when driven to the maximum extent possible since the diaphragm may be more highly tensioned than a thin film diaphragm.

In use, the variable current audio signal flowing in the wire 6 causes a variable magnetic field which reacts with the magnetic field between the adjacent magnet 7 to cause the closed portion 5 of the diaphragm to be driven to create the desired sound. Since the closed portion 5 does not extend to the edges of diaphragm, the open weave edge portions 5A have significantly less influence on the sound produced, since these undriven portions of the diaphragm will generate substantially no sound waves as the diaphragm is driven. In the case of a solid diaphragm, the outer portions of the diaphragm will displace air and will therefore influence the sound produced in a manner which colors that sound undesirably. These advantages, in combination with the better handling and strength characteristics of woven cloth result in a superior quality product and superior sound reproduction.

As mentioned above, the openness of the woven cloth may be varied to create different effects. In the case of the screen printing cloth, by varying the mesh of the cloth between about 90 and 120 filaments per centimeter, the desired response may be obtained. Similarly by varying the gauge of the copper wire which is bonded to the diaphragm between about 0.2 mm and 0.5 mm, good sound reproduction may be achieved. For example, in the embodiment shown, the mid speaker uses 120 threads/cm cloth with 0.4 mm wire, the Hi speaker uses 120 threads/cm cloth with 0.2 to 0.25 mm wire, while the Lo speaker use 100 threads/cm cloth with 0.4 to 0.5 mm wire.

By wiring the speaker elements in series, as shown in FIG. 1 of the drawings, and by positioning the high frequency speaker element between the mid-range and low frequency speaker elements, one combination speaker will cover most of the frequencies in the audio spectrum, with the exception of very low frequencies which, in common with other planar diaphragm speakers, must be handled by a conventional low frequency cone woofer or by a larger planar panel. This removes the need for passive components and cross-over networks while producing sounds having lower distortion and out of phase signal overlap between speaker elements or drivers resulting in better image stability.

It has been found by placing the higher frequency speaker element at the center point of the speaker, and the lower frequency speaker elements above and below, all signals, whether of high or low frequency will tend to center on the high frequency speaker element in the same manner as equal intensity signals will center between two speakers in the stereophonic mode. The sound produced has an "airy and open" nature and is therefore more akin to live hearing.

As an alternative to the speaker arrangement described above, a speaker comprising two speaker elements, one biased towards the high frequencies and one biased towards the low frequencies may produce acceptable sound when matched with one or two conventional woofers. For less critical sound reproduction, one speaker element only may be used, possibly in combination with a conventional woofer arranged to cross over at about 200–300 Hz.

Where a multiplicity of speaker elements is used, it is necessary to use two power amplifiers with a 80 Hz–100 Hz electronic cross over between the pre-amplifier and the two power amplifier. For economy it is possible to send left and right bass signals and drive one center bass transducer from one bass amplifier. This frequency is selected to reduce the deflection of the diaphragms to render Doppler distortion inaudible at high listening levels and to prevent the current carrying conductors moving too far away from the strongest part of the magnetic field.

The inventor prefers the use of a conventional driver with a cone constructed of kevlar which is extremely rigid, light and fast, to match the speed of the panels but the invention also covers the construction of a bass panel which is about 6" wide×30" high and is wired with a double run of 0.5 mm wire on a 90 or 120 mesh with a photographic film area to seal the mesh. Such a speaker has a margin of at least 2" of open mesh around the driven area and should be mounted on a separate baffle so as not to interfere with the critical mid-range panel.

Referring now to FIGS. 5 and 6, the speaker panel in accordance with this preferred embodiment is constructed as described above with reference to FIGS. 1 to 4, and includes a substantially rigid frame 20, a central planar diaphragm 21 supporting a conductive voice coil or grid 22 secured to the diaphragm 21, the frame having attached to the rear thereof a supporting frame as described in the previous embodiment supporting an array of magnets generating magnetic fields which intersect the voice coil or grid 22.

A pair of spaced parallel cross members 23 and 24 extend across the front of the frame 20 and each cross member 23 and 24 has a central foot 25 and 26 which engages and is adhesively secured to the front face of the diaphragm 21. This engagement stabilizes the diaphragm and prevents the sound produced by the speaker from "breaking up", under high power input. If desired, the cross members may be replaced by a single central cross member, particularly where the dimensions of the speaker panel are small.

The cross members 23 and 24 support a pair of spaced symmetrical louvres 27 and 28 which extend longitudinally of the exposed portion of the diaphragm 21 and within the outer frame 20. In the present embodiment, the louvres 27 and 28 are slotted to engage the cross members 23 and 24, and may be secured thereto in any suitable way, such as by gluing. In this embodiment, the louvres are manufactured from thin strips of balsa wood, although they may be made from any suitable material, including plastics, aluminium or heavier wood.

The louvres are arranged to be at about 45° to the plane of the diaphragm 21 and extend in opposite directions towards opposite sides of the frame 20 leaving a narrow central region 26 of the diaphragm 21 exposed. the position of the louvres in this manner increases the dispersion of the sound generated by the speaker and creates a narrow line source at the center of the speaker which significantly improves the quality of reproduction. As shown in FIG. 6, the side frame members 20 have arcuate outer surfaces 27 to reduce any adverse effects caused by sharp edges. If desired, the louvres may be similarly curved as shown in FIG. 6.

While the speaker may be constructed in accordance with the previous embodiment, the diaphragm is preferably constructed from finer woven mesh, preferably comprising a thread diameter of about 0.03 mm woven at about 120 lines per centimeter. Such cloth is lighter than the cloths described above resulting in further improved sound reproduction.

It is also advantageous to wire the diaphragms of the speakers in a manner which provides two or more separate voice grid units on each diaphragm to allow the separate units to be connected in series or in parallel to thereby optimize the impedance at around say 3 to 4 ohms of total system to maximize the power from the driving amplifier. The use of different wire gauges in each unit also serves to spread any resonant effects over a wider frequency band.

One typical arrangement is shown schematically in FIG. 7 of the drawings. The separate drivers or voice grids shown may be connected in different series or parallel configurations to provide the required overall impedance.

In the arrangement shown in FIG. 7, a lower frequency panel 30 has two voice coil units 31 and 32 of 0.4 mm wire and 0.6 mm wire respectively, while a higher frequency panel 33 has three voice coil units 34, 35 and 36 of 0.25 mm, 0.22 mm and 0.25 mm diameter respectively. Thus, the lower frequency panel is effectively equal to two separate drivers, while the higher frequency panel is effectively equal to three separate drivers.

The above described embodiments of the invention have the following advantages over existing planar or electrostatic speakers having thin filmed diaphragms. The woven cloth diaphragm is more easily tensioned to the required degree to produce best results, and such speakers are more easily repaired if damaged by being overdriven, or in some other way. The applicant's experience is that existing speakers incorporating thin filmed diaphragms are virtually impossible to repair when damaged and must therefore be regarded as being disposable in the event of damage.

The size of the speaker or speaker elements embodying the invention is substantially less than the sizes of equivalent speakers according to the prior art. Most commercially available planar or electrostatic speakers are very large in area in order to generate enough efficiency to be driven by a practical power amplifier. The present applicant believes that the sound source should be as small as possible and that the larger the diaphragm area, the poorer the sound reproduction. In the present embodiments, the driven area of each speaker element or speaker is significantly smaller than the driven area of equivalent commercially available planar speakers. The size of the driven area is dictated primarily by the gauge of wire selected for the voice coil or grid consistent with a speaker impedance of the order of 4 ohms.

The use of a lightweight woven cloth diaphragm enables the size of the diaphragm to be reduced to a much more domestically acceptable value without losing much efficiency and without adding coloration to the sound reproduction.

The use of louvres in overlying relationship with the diaphragm increases the dispersion of the sound generated by the audio transducer and creates a narrow central portion of the speaker which acts in the nature of a line source, which in turn improves the performance of the speaker in addition to increasing the dispersion of the sound produced thereby.

The speakers embodying the invention do not require passive cross-over networks, as in the case of some prior art speakers and the maximum diaphragm excursion is reduced in the case of the embodiments described so as to significantly reduce doppler distortions.

As described above, one embodiment of the invention uses only two speaker elements or panels for each channel making the overall speaker dimensions about 45"×10.5"×2" deep. Such a speaker is capable of handling all frequencies between 80 Hz and 20,000 Hz with a great degree of realism. This is capable of being achieved because the diaphragms of each speaker element are of a fairly high mass so that they add the necessary weight to the lower mid to upper base range. In this regard, a thin film diaphragm does not have the necessary mass and therefore generates less realistic sound. Despite the higher mass of the open mesh diaphragms, they are believed to be much more inert than a thin film diaphragm and therefore add less of their own character to the sound reproduced.

The speakers embodying the invention are also capable of generating high frequencies without having to resort to separate tweeter speakers with the necessary passive cross-over networks, as in the case of the prior art thin film speakers.

The speakers embodying the invention can be made to acoustically match a conventional base cone type woofer. This is not achievable with most thin film diaphragm speakers.

The claims defining the invention are as follows:

1. An audio transducer comprising a planar diaphragm, a conductor defining a voice coil secured to said diaphragm, and means for creating magnetic fields which intersect said conductor, said diaphragm being supported in a tensioned overlying relationship with said magnetic field creating means, characterized in that said planar diaphragm comprises a lightweight woven cloth having a first region substantially coincident with said voice coil treated to close the open mesh of the woven cloth, and a second region substantially surrounding said first region in which the mesh of said cloth is substantially open and baffle means overlying but spaced from said second region.

2. The transducer of claim 1, wherein said cloth comprises a woven mesh of monofilaments having a predetermined weight, thickness and strength.

3. The transducer of claim 2, wherein said cloth has from 95 to 185 filaments per centimeter selected having regard to the frequency range to be generated by the transducer.

4. The transducer of claim 3, wherein said mesh is woven with about 120 filaments per centimeter from threads having a diameter of about 0.03 mm.

5. The transducer of claim 1, wherein said conductor has a diameter of about 0.2 mm to 0.5 mm selected having regard to the frequency range to be generated by the transducer.

6. The transducer of claim 1, wherein said baffle means comprises a frame to which said cloth is attached at its edges.

7. The transducer of claim 1, wherein said magnetic field creating means comprises an array of permanent bar magnets carried by a rigid frame with the magnets extending in spaced rows which are parallel to the voice coil.

8. The transducer of claim 6, wherein said cloth is attached to the frame by strips of material of lower density than the material of said frame.

9. The transducer of claim 8, wherein said cloth is tensioned by means of an element wedged between said frame and the cloth attached to said frame.

10. The transducer of claim 1, further comprising at least two generally planar louvres mounted in overlying relationship with said diaphragm and supported at an angle to the plane of said diaphragm of about 45°, said louvres being spaced in a symmetrical relationship to leave a central strip of said diaphragm exposed and being inclined toward opposite sides of said planar diaphragm.

11. A loudspeaker, comprising at least two of the audio transducers of claim 1 connected in series without intervening cross-over networks to form a loudspeaker, with each audio transducer being adapted to reproduce a different frequency range by the selection of a suitable conductor diameter.

12. The loudspeaker of claim 11, wherein each of said audio transducers comprises at least two separate conductors carried by a single planar diaphragm.

13. An audio transducer comprising a planar diaphragm, a conductor defining a voice coil secured to said diaphragm, and means for creating magnetic fields which intersect said conductor, said diaphragm being supported by a surrounding frame member such that a generally rectangular portion of said diaphragm is exposed, characterized by at least two generally planar louvres mounted in overlying relationship with said diaphragm and supported at an angle to the plane of said diaphragm of about 45°, said louvres being spaced in a symmetric relationship to leave a central strip of said diaphragm exposed and being inclined towards opposite sides of said diaphragm.

14. The audio transducer of claim 13, wherein the sides of said surrounding frame member have arcuate outer surfaces and said louvres are similarly curved.

* * * * *